US005929721A

United States Patent [19]

Munn et al.

[11] Patent Number: 5,929,721

[45] Date of Patent: Jul. 27, 1999

[54] CERAMIC FILTER WITH INTEGRATED HARMONIC RESPONSE SUPPRESSION USING ORTHOGONALLY ORIENTED LOW-PASS FILTER

[75] Inventors: Robert J. Munn; David R. Heine; Mark H. Ballance, all of Albuquerque, N.M.

[73] Assignee: Motorola Inc., Schaumburg, Ill.

[21] Appl. No.: 08/692,547

[22] Filed: Aug. 6, 1996

[51] Int. Cl.[6] ..... H01P 1/213; H01P 1/201

[52] U.S. Cl. ..... 333/134; 333/202; 333/206

[58] Field of Search ..... 333/134, 203, 333/206, 222, 202, FOR 202 DB

[56] References Cited

U.S. PATENT DOCUMENTS

| | | | |
|---|---|---|---|
| 4,823,098 | 4/1989 | De Muro et al. | 333/202 X |
| 4,896,124 | 1/1990 | Schwent | 333/202 X |
| 5,023,866 | 6/1991 | De Muro | 333/202 X |
| 5,731,746 | 3/1998 | Sokola et al. | 333/202 X |

FOREIGN PATENT DOCUMENTS

| | | | |
|---|---|---|---|
| 5335806 | 12/1993 | Japan | 333/202 DB |
| 5335807 | 12/1993 | Japan | 333/206 |

*Primary Examiner*—Benny Lee

*Attorney, Agent, or Firm*—Brian M. Mancini; Gary J. Cunningham

[57] ABSTRACT

A ceramic filter (100) with integrated harmonic response suppression has a ceramic monolithic block filter having a predetermined passband defined by tuned resonators located between an input and an output (116); and at least one of a harmonic trap filter, a lowpass filter and a lowpass microstrip filter, each having an inductive and a capacitive component. This is achievable with a design which incorporates an integrated harmonic response suppression filter directly in or on the dielectric ceramic monolithic block. This can result in a substantial savings in space, cost, and part count in an electronic telecommunications device.

5 Claims, 4 Drawing Sheets

HARMONIC TRAP FILTER

ORTHOGONAL CAVITY LOWPASS FILTER

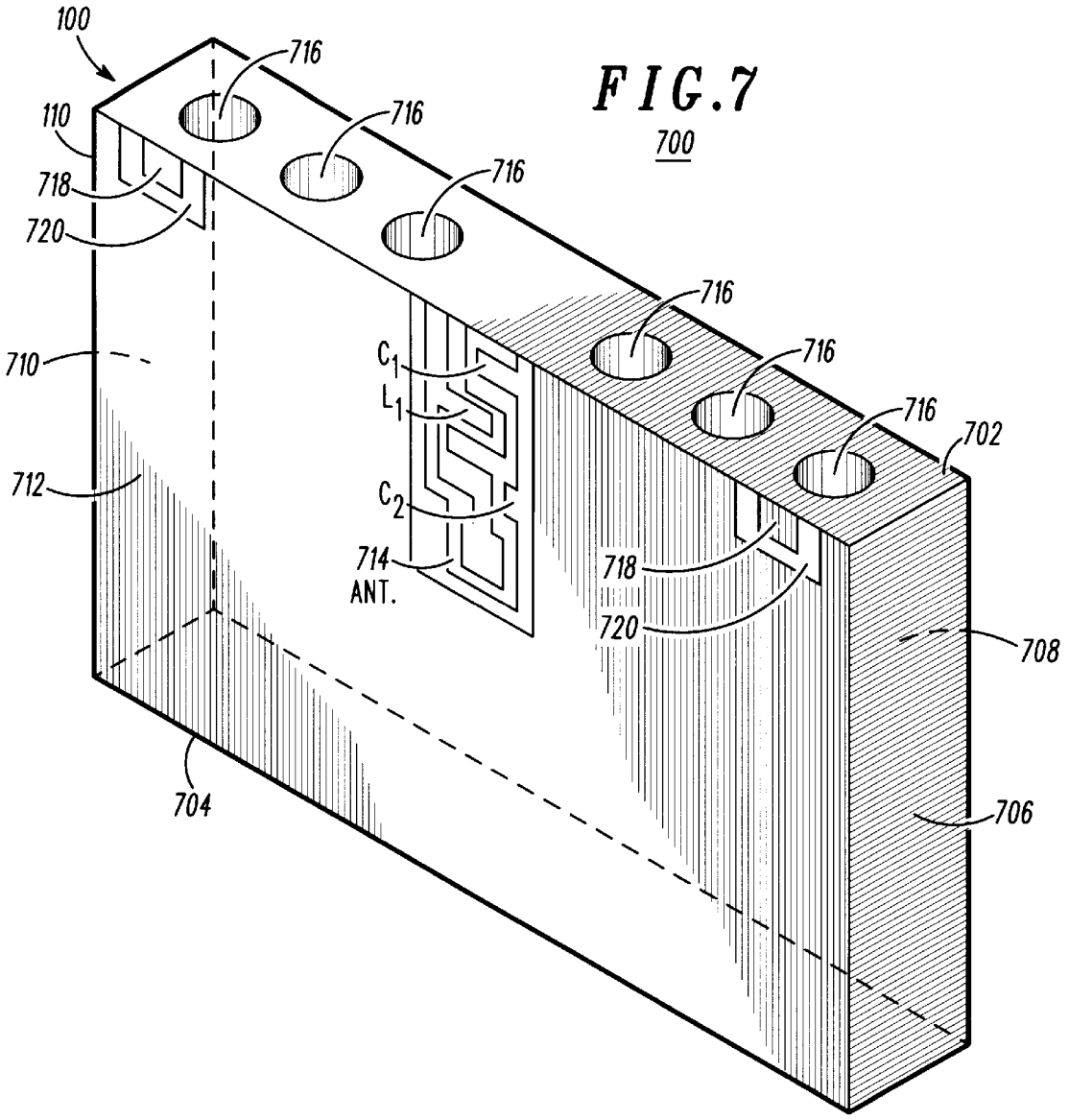
FIG.7
700
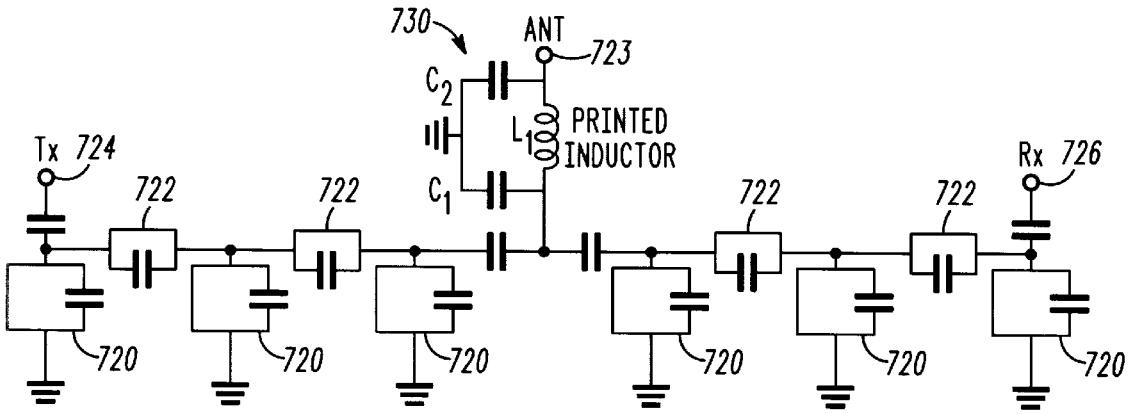
FIG.8 MICROSTRIP LOWPASS FILTER

CERAMIC FILTER WITH INTEGRATED HARMONIC RESPONSE SUPPRESSION USING ORTHOGONALLY ORIENTED LOW-PASS FILTER

FIELD OF THE INVENTION

This invention relates to ceramic block filters, and particularly to ceramic filters with integrated harmonic response suppression.

BACKGROUND OF THE INVENTION

Filters are known to provide attenuation of signals having frequencies outside of a particular frequency range and little attenuation to signals having frequencies within the particular frequency range of interest. It is also known that these filters may be fabricated from ceramic materials having one or more resonators formed therein. A ceramic filter may be constructed to provide a lowpass filter, bandpass filter or a highpass filter, for example.

Certain monolithic block ceramic microwave filters, however, also exhibit undesirable passbands at odd harmonic frequencies. This problem typically is present only in higher order modes. This problem is due to the fact that monolithic block filters are made up of quarter wavelength short-circuited transmission lines. As such, resonant transmission lines repeat their characteristics at every half wavelength. At odd quarter-wavelengths, one quarter wavelength and three quarter wavelengths, for example, the electrical impedances of the transmission lines are identical, resulting in unwanted passbands.

The problems presented by these undesired passbands cannot be understated. Oftentimes, the interference will show up in the 2.4–2.7 GHz range at 3*fo the fundamental frequency. At a minimum, there will be unwanted noise in the signal, and if the interference is sufficiently strong, it may result in the telephone call in a cellular system being dropped. This can be both time consuming and annoying for the customer. Additionally, the transmission of harmonics at higher frequencies may create issues for a telecommunications provider which would have to be dealt with by the Federal Communication Commission (FCC).

Consequently, many designers of systems such as cellular telephones need additional attenuation over that provided by traditional monolithic block ceramic filters. To address this problem, designers oftentimes place a second lowpass filter in line to suppress unwanted harmonic responses. This solution, unfortunately, is both expensive and time consuming, and may significantly add to the cost, weight, and part count of a completed product such as a cellular telephone, pager or other electronic signal processing apparatus.

A design which incorporates an integrated harmonic response suppression filter directly into the dielectric ceramic monolithic block could result in a substantial savings in both space and cost.

Another solution to this problem is to add lumped components to the printed circuit board, thereby creating an assembly which properly couples and loads the resonators to eliminate the higher unwanted frequencies. This solution is also expensive, labor intensive, and time consuming.

A ceramic filter with an integrated harmonic response suppression feature which eliminates higher order modes would be considered an improvement in the art.

BRIEF DESCRIPTION OF THE DRAWINGS

FIG. 7 is a perspective view of another embodiment of a ceramic filter with integrated harmonic response suppression, in accordance with the present invention.

FIG. 8 is an equivalent circuit diagram of the filter shown in FIG. 7, in accordance with the present invention.

DETAILED DESCRIPTION OF THE PREFERRED EMBODIMENT

Figure 1:
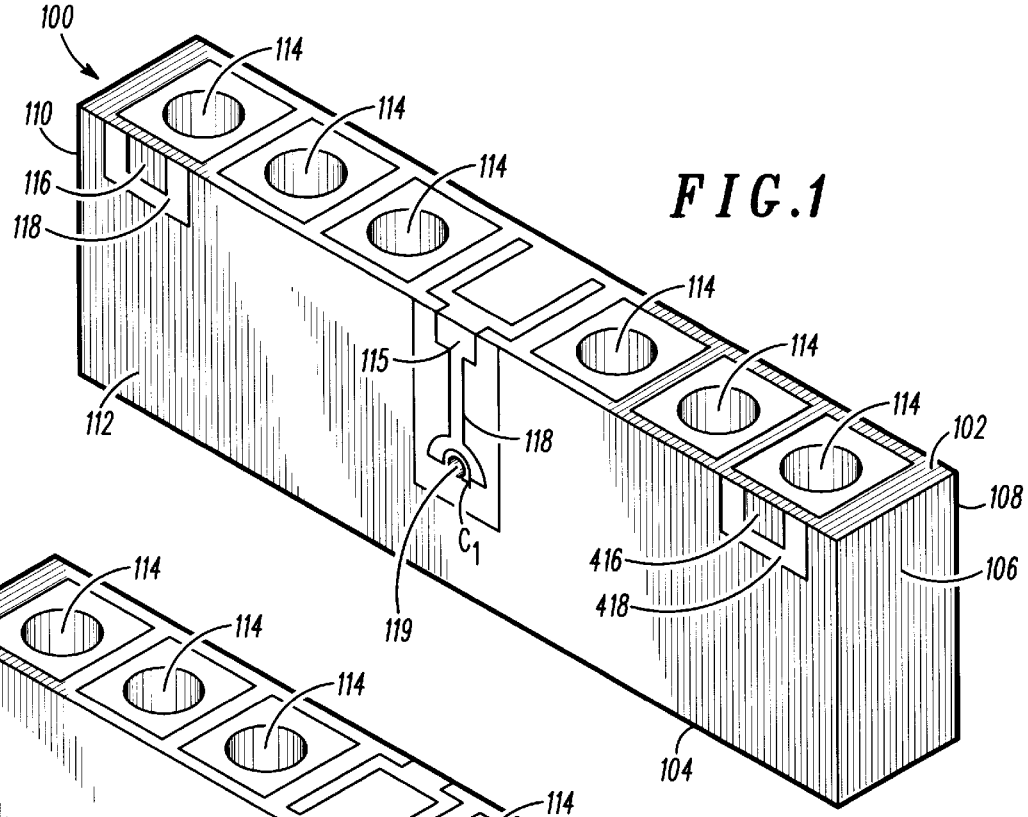
FIG. 1 is a front-perspective view of a ceramic duplexer filter with integrated harmonic response suppression, in accordance with the present invention.

FIG. 1 shows a ceramic duplexer filter 100 with an integrated harmonic response suppression which employs a high frequency orthogonal harmonic trap filter. The filter 100 has a top surface 102, a bottom surface 104, and four side surfaces 106, 108, 110 and 112. The filter 100 in FIG. 1 also has a plurality of resonators 114 which extend between the top 102 and bottom 104 surfaces of the filter and are metallized with a conductive material. In FIG. 1, the filter 100 is shown as a duplex filter, wherein a transmit (Tx) filter is built into the same block of ceramic as the receive (Rx) filter and they therefore share a common antenna (ANT) input-output terminal 115. The input/output terminals 115, 116 are surrounded by areas of unmetallized dielectric ceramic 118.

In FIG. 1, suppression of undesired harmonics occurs through the introduction of a harmonic trap filter built directly into the side surface of the dielectric block filter. The harmonic trap filter has a single resonator 119 which is located in a plane which is perpendicular to the plane of the resonators of the ceramic monolithic block filter, thus creating an orthogonal harmonic trap filter. The filter 100 is capacitively coupled to the input-output pad 115 of the ceramic monolithic block filter. The unmetallized area on the front surface of the block immediately surrounding the orthogonal resonator creates a capacitance C1.

In the design of the orthogonal trap filter 100, are many important design considerations including the shape and diameter of the single resonator through hole 119, the metallization pattern, on both side surfaces of the dielectric block, which surround the orthogonal resonator 119 (which creates the harmonic trap filter), and also the overall block dimensions, especially the length of the orthogonal filter resonator which corresponds to the overall thickness of the dielectric ceramic block. This thickness dimension is shown as "X" in FIG. 2.

It is important to note that although FIG. 1 shows the integrated harmonic suppression filter being used in conjunction with a duplexer filter, the present invention could also be applied to any multi-resonator ceramic filter used in the electronics industry.

Figure 2:
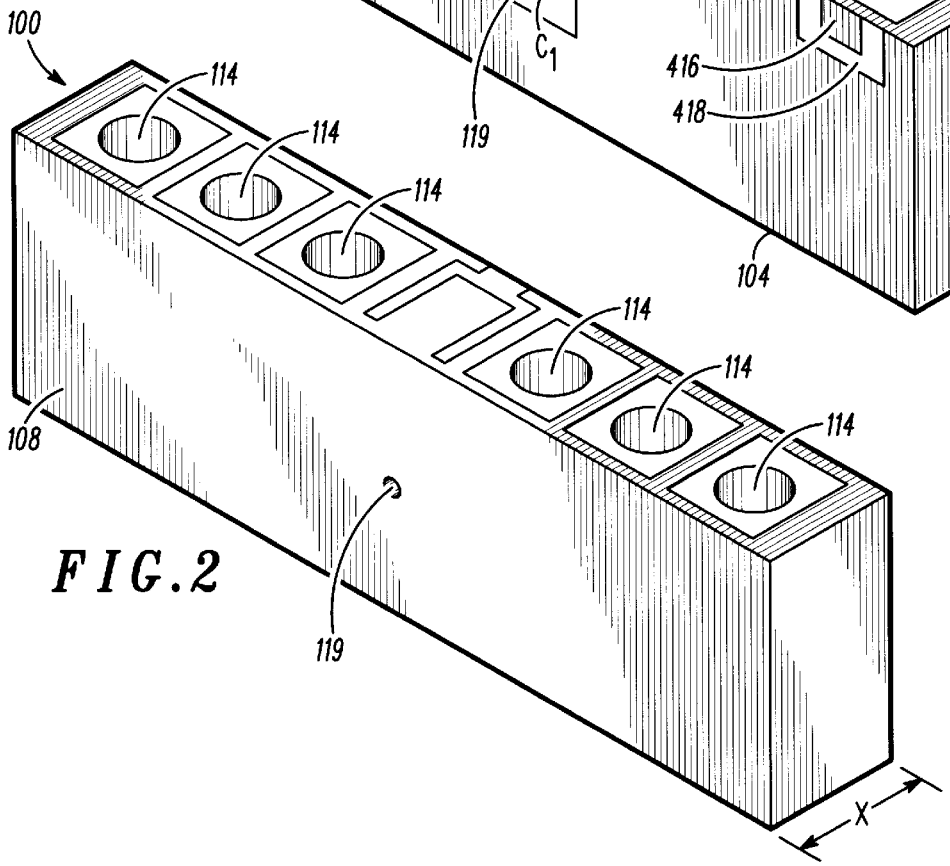
FIG. 2 is a rear-perspective view of the ceramic duplexer filter shown in FIG. 1, in accordance with the present invention.

FIG. 2 shows a rear-perspective view of the ceramic duplexer filter 100 shown in FIG. 1. From this view, the opposite side surface, where the through hole 119 which forms the resonator of the second orthogonal harmonic trap filter exits the dielectric block, is provided. In this embodiment, the entire rear surface 108 of the dielectric block is metallized. The filter in FIG. 2 also has a plurality of resonators 114 which are metallized with a conductive material.

Figure 3:
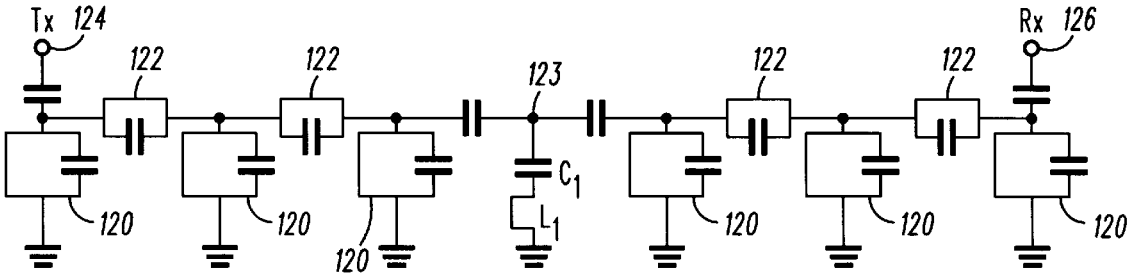
FIG. 3 is an equivalent circuit diagram of the filter shown in FIGS. 1 and 2, in accordance with the present invention.

FIG. 3 shows an equivalent circuit diagram of the filter 100 shown in FIG. 1. In this diagram, the resonators of the ceramic monolithic block filter form transmission lines having a capacitance to ground 120. A predetermined metallization pattern on the top surface 102 of the filter creates a capacitive coupling 122 between the resonators. The transmit (Tx) input 124 is capacitively coupled to an end resonator and the receive (Rx) input 126 is capacitively coupled to the end resonator at the opposite end of the filter block.

A unique feature of the present invention is the series resonant-circuit shown in the electrical schematic diagram as the transmission line which is connected to the antenna (ANT) port 123. By designing the filter in this manner, suppression of unwanted harmonics can be achieved. In particular, a first capacitance (C1) and an inductance (L1) are electrically connected in series to create a harmonic trap filter series-resonant circuit, as shown in FIG. 3.

For the filter shown in FIGS. 1 through 3, higher order harmonics are reduced with a simple L-C trap filter. This is implemented by the use of a quarter-wavelength transmission line resonator which operates at the frequency where harmonic suppression is desired. One way to create a quarter-wavelength resonator (which resonates at a frequency which is much higher than the other resonators in the block) involves creating a cavity in the narrow direction of the block. In effect, the orthogonal hole 119 acts as an electrical inductor. In one embodiment, one orthogonal trap can also be connected to each electrical input or output port on the filter. Also, by loading certain capacitances on the filter, broader band or selective frequency traps can be created on the exterior surfaces of the filter, for example.

The diameter and shape of the orthogonal resonator hole 119 is an important aspect of the present invention. The diameter and shape of the orthogonal resonator hole 119 will be determined by the overall block dimensions and the dielectric constant of the ceramic material used for the filter. Of course, the orthogonal resonator through hole will be designed to filter specific predetermined frequencies. The orthogonal resonator hole 119 will be substantially coated with a metallization material and should be electrically grounded in this embodiment of the invention.

In the filter shown in FIGS. 1 through 3, it is desirable to have a metallization pattern on the top surface of the filter which can then be electrically connected to and designed in conjunction with the metallization pattern which surrounds the orthogonal through hole 119.

The method of electrically connecting the orthogonal filter to the block filter could be achieved in any number of ways. The use of a printed transmission line is one alternative, however, a metallic wire could also be used to achieve the same result and provide a substantially equivalent circuit diagram. Additionally, other connection methods can also be used. It is important, however, that the harmonic trap filter (also referred to as an orthogonal or notch filter), be electrically connected directly to the input-output pads on the monolithic block ceramic filter) to obtain the desired circuit configuration. As such, a standard series-resonant filter is created.

The electrical loss factor which can be eliminated through the use of an orthogonal filter is substantial. In fact, there will be little or no loss in the passband when an orthogonal harmonic trap filter is employed. This is due to the fact that the electrical Q value for the orthogonal hole is much greater than that of the printed elements. In effect, the orthogonal filter substantially eliminates one of the offending higher mode frequencies.

Figure 4:
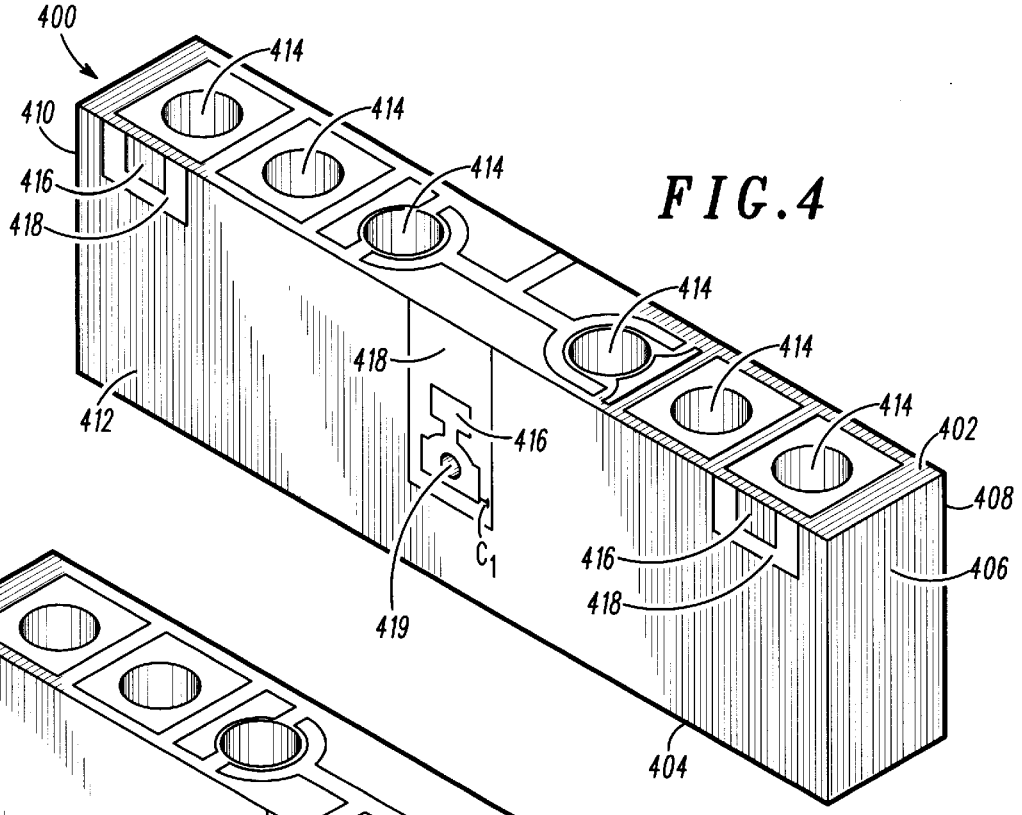
FIG. 4 is another embodiment of a ceramic duplexer filter with integrated harmonic response suppression, in accordance with the present invention.
Figure 5:
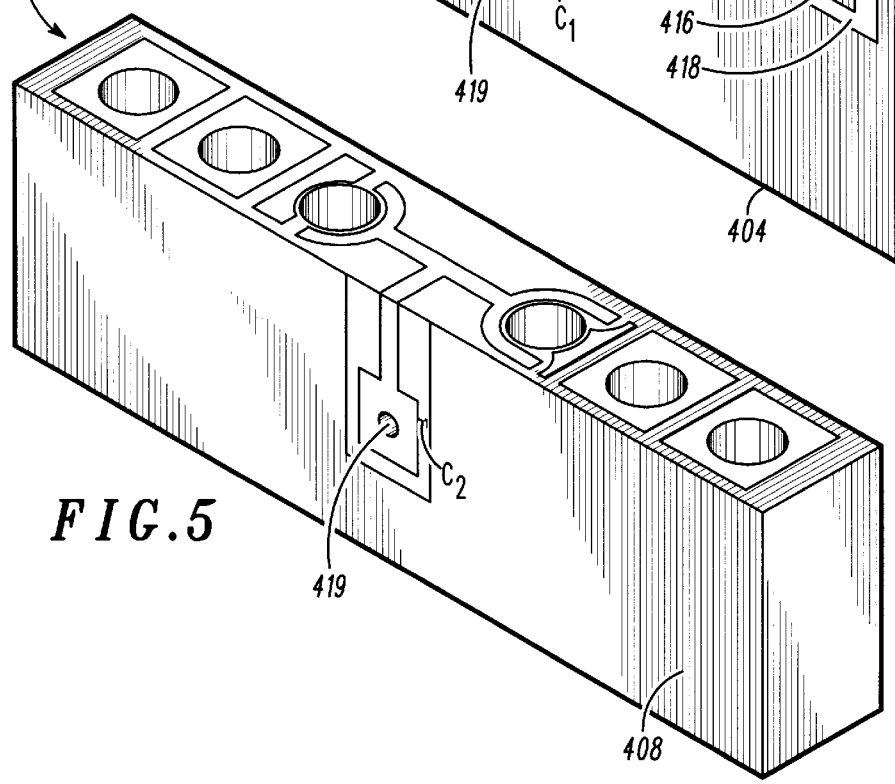
FIG. 5 is a rear-perspective view of the ceramic duplexer filter shown in FIG. 4, in accordance with the present invention.
Figure 6:
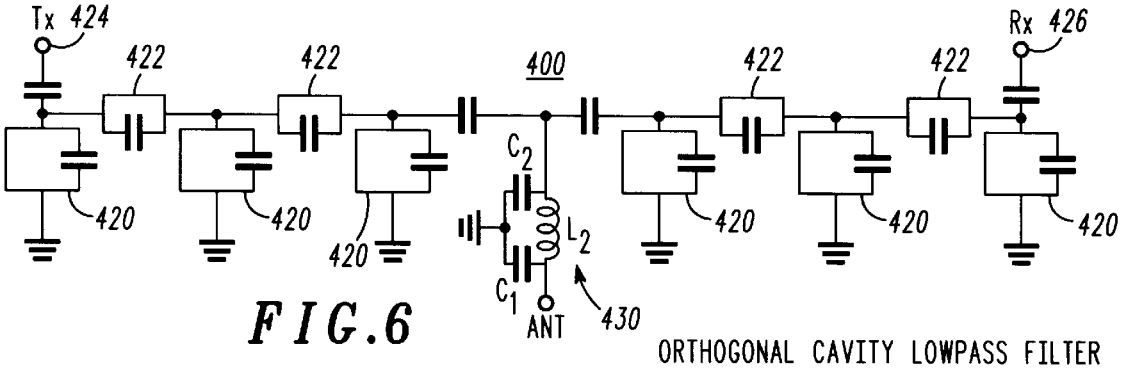
FIG. 6 is an equivalent circuit diagram of the filter shown in FIGS. 4 and 5, in accordance with the present invention.

FIGS. 4 through 6 show another embodiment of a ceramic duplexer filter with integrated harmonic response suppression. As can be clearly seen from the drawing, this embodiment is similar to the embodiment shown in FIGS. 1–3 in the sense that both designs employ orthogonal through holes 119 and 419 respectively. However, in the embodiment shown in FIGS. 4–6, a lowpass filter is created.

FIG. 4 shows a ceramic duplexer filter 400 with integrated harmonic response suppression employing a lowpass filter. The filter 400 has a top surface 402, a bottom surface 404, and four side surfaces 406, 408, 410 and 412, and has a plurality of resonators 414 which extend between the top 402 and bottom 404 surfaces of the filter 400 and are metallized with a conductive material. The input/output terminals 416 are surrounded by areas of unmetallized dielectric ceramic 418. In filter 400, a capacitance (C1) is created on the input-output pad side surface of the filter 412, near the orthogonal cavity lowpass filter resonator through hole 419.

FIG. 5 shows a view of the opposite or rear side surface 408 of the (lowpass) filter 400 shown in FIG. 4. From this view, it can be seen that the filter 400 resonator through hole 419 is electrically isolated from the metallization on the rear surface 408 of the monolithic block filter. Thus, a capacitive coupling (C2) is created on the rear surface 408 of the filter. Also, the lowpass filter is electrically coupled to the resonators of the monolithic block ceramic filter.

FIG. 6 shows an equivalent circuit diagram of the filter 400 shown in FIGS. 4 and 5. In this diagram, the resonators of the monolithic block ceramic filter form transmission lines with a desired capacitance to ground 420. A predetermined metallization pattern on the top surface 402 of the filter creates a capacitive coupling 422 between the resonators.

The transmit (Tx) input 424 is capacitively coupled to an end resonator and the receive (Rx) input 426 is capacitively coupled to the end resonator at the opposite end of the filter block. Note that a suppression circuit 430 is located between the input-output port (also known as the common duplexer port), and the antenna (ANT) port.

Capacitance (C1) can be defined by the distance between the lowpass filter resonator through hole 419 and the metallization pattern on the front input-output pad side surface 412 of the filter block. Capacitance (C2) can be defined by the distance between the orthogonal cavity lowpass filter resonator through hole 419 and the metallization pattern on the rear (non-input-output pad side) surface 408 of the filter block. Inductance ($L_2$) completes the suppression circuit 430.

FIG. 7 is a perspective view of another embodiment of a ceramic filter 700 with an integrated harmonic response suppression. In FIG. 7, a microstrip lowpass filter is shown.

In this embodiment, a printed feature transmission line is placed on an exterior side surface of the ceramic filter block in order to achieve harmonic suppression. In this embodiment, the transmission line printed on the side surface of the filter 700 acts as an electrical microstrip inductor.

The use of a printed pattern on a side surface of the filter 700 provides for an integrated filter with harmonic suppression, and eliminates or minimizes the necessity of an outboard filter. The printed pattern in this embodiment serves the same purpose as the orthogonal cavity shown in the other embodiments (i.e., 100 and 400) of the filter.

In this embodiment, a specific metallized pattern appears on a side surface of the filter which is otherwise completely covered with a metallization layer or coating defining a silver or conductive ground plane. Although this has been referred to as a printed pattern, screen printing is just one of the methods by which this pattern can be applied. If the pattern were sufficiently nonintricate, then it could possibly be applied by a selective metal removal operation or other process which is less expensive or labor intensive. In a preferred embodiment, the side surface pattern would be formed at the same time and by the same methods as are used to form the input-output pads on the same side surface of the block.

Important design considerations for a printed integrated filter include, among other things, the length of the printed transmission line, the width of the printed transmission line, the size and shape of the unmetallized region surrounding the printed transmission line, and the overall size and length of the printed transmission line on the side of the ceramic block.

Referring to FIG. 7, a ceramic block filter 700 is provided having a top surface 702, a bottom surface 704, and four side surfaces 706, 708, 710, and 712. The printed metallization pattern 714 is placed on the side surface 712. The filter 700 also contains a plurality of metallized through holes 716 defining resonators. All exterior surfaces of the filter 704, 706, 708, 710 are substantially covered with a conductive material with the exception that the top surface 702 and the front surface 712 of the filter contain printed metallization patterns which are surrounded by areas of unmetallized dielectric. The input-output pads 718 are coated with a conductive material and are surrounded by an unmetallized dielectric region 720. A common input-output port on side surface 712 serves as an antenna (ANT) port.

Referring to the integrated printed inductor pattern 714 in FIG. 7, it is apparent that this is in the form of a series resonant circuit. The unmetallized regions on the front surface of the filter define the gaps which create (C1) and (C2). The metallized transmission line pattern defines the inductance (L1). By simply changing the basic shape and lengths of the transmission line and it's corresponding unmetallized regions, a number of designs are possible. Each design can be varied as desired, to comply with the requirements of the filter 700.

Although the patterned lowpass harmonic filter is subject to a large number of variations, there are some constraints which govern the design of this filter, in certain preferred embodiments. For example, in certain embodiments, the transmission line should originate and terminate on the top surface of the filter, the transmission line should be electrically coupled to the printed pattern on the top surface of the filter block, and the transmission line should be electrically isolated from the conductive ground plane on the front surface of the filter 700.

FIG. 8 is an equivalent circuit diagram of the filter 700 shown in FIG. 7. In this diagram, the resonators 720 of the ceramic monolithic block form transmission lines having a capacitance to ground. In one embodiment, a predetermined metallization pattern on the top surface 702 of the filter can create a capacitive coupling 722 between the resonators. The transmit (Tx) input 724 is capacitively coupled to an end resonator and the receive (Rx) input 726 is capacitively coupled to the end resonator at the opposite end of the filter block.

A suppression circuit 730, in the form of a series resonant-circuit, is shown (and implemented by the transmission line pattern 714 as shown in FIG. 7) connected to the antenna (ANT) port 723. By designing the filter in this manner, suppression of the unwanted harmonics can be achieved. In particular, a printed lowpass filter is formed which comprises a first capacitance (C1), an inductance (L1), in the form of a printed inductor a second capacitance (C2), and a ground. According to this design, the capacitances (C1) and (C2) are connected between either end of the inductance (L1) and electrical ground to achieve the desired electrical result. The unique printed inductor pattern of the present invention is coupled to the antenna port 723 of the filter.

Figure 9:
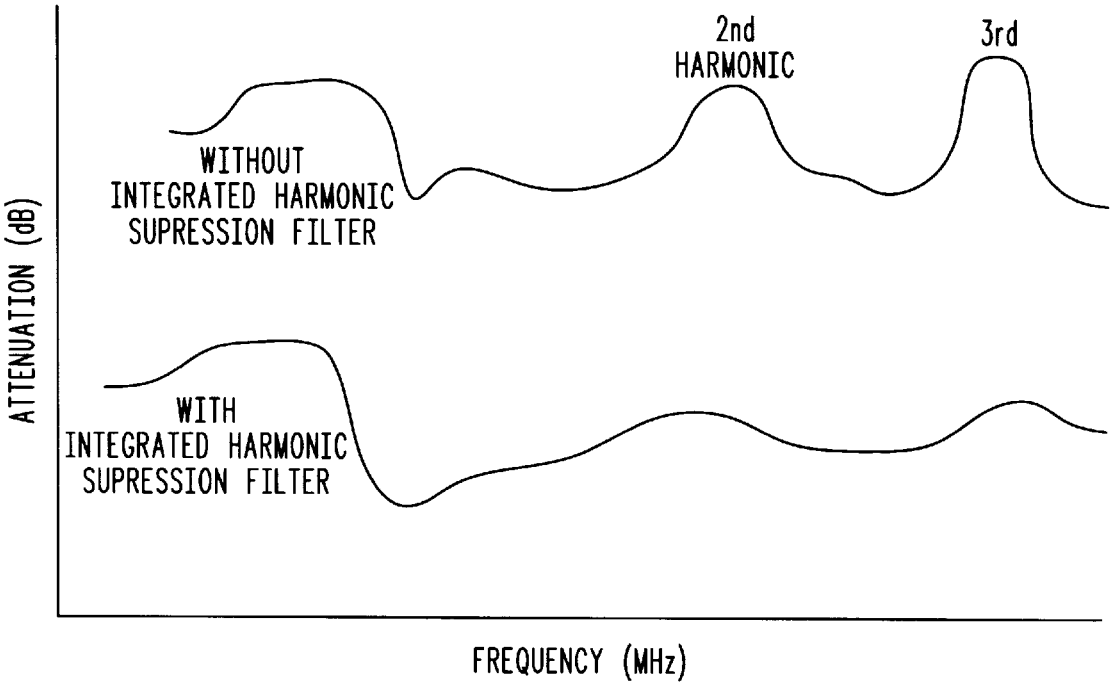
FIG. 9 is a graph which shows the change in the electrical response achievable by integrating harmonic response suppression in the filters shown in FIGS. 1 through 8, in accordance with the present invention.

FIG. 9 shows the change in the electrical response achievable by integrating harmonic response suppression in the filters shown in FIGS. 1 through 8. FIG. 9 shows a plot of the Attenuation (measured in dB) on a vertical axis versus Frequency (measured in mHz) on a horizontal axis. From this plot, it can be seen that the addition of a lowpass filter integrated directly into or onto a monolithic block ceramic dielectric filter (lower curve) can result in the effective elimination of higher order modes, more specifically the second and third harmonics as compared to a ceramic dielectric filter without the integrated harmonic filter (top curve).

Although various embodiments of this invention have been shown and described, it should be understood that various modifications and substitutions, as well as rearrangements and combinations of the preceding embodiments can be made by those skilled in the art, without departing from the novel spirit and scope of this invention.

What is claimed is:

1. A ceramic filter with integrated harmonic response suppression, comprising:

a ceramic monolithic block filter having a predetermined passband defined by tuned resonators located within the monolithic block between an input pad and an output pad; and a lowpass filter having a resonator cavity, substantially perpendicular to all of the tuned resonators, coupled to one of the input pad and the output pad, and comprising a circuit having an inductive element, a first capacitive element and a second capacitive element, the circuit providing higher order harmonic suppression;

the inductive element provided by the resonator cavity;

the first capacitive element is defined by a first substantially rectangular unmetallized region having a first predetermined metallized region therein and an adjacent shield metallization which substantially surrounds side surfaces of the monolithic block filter, the first predetermined metallized region connected to the resonator cavity on a first one of said side surfaces of the ceramic monolithic block filter, and connected to said one of the input pad and the output pad;

the second capacitive element is defined by a second substantially rectangular unmetallized region having a second predetermined metallized region therein and said adjacent shield metallization which substantially surrounds the side surfaces of the monolithic block filter, the second predetermined metallized region connected to the resonator cavity on a second one of said side surfaces of the ceramic monolithic block filter, and is capacitively coupled to the tuned resonators; and the ceramic monolithic block filter defining a first filter and the lowpass filter defining a second filter.

2. The ceramic filter of claim 1, wherein the lowpass filter is coupled between the ceramic monolithic block filter and an antenna pad defined by said one of the input pad and output pad.

3. The ceramic filter of claim 1, wherein a metallization pattern connects said one of the input pad and the output pad of the ceramic monolithic block filter with the lowpass filter, the metallization pattern also creating a capacitive coupling between adjacent ones of the tuned resonators.

4. The ceramic filter of claim 1, wherein a frequency of the lowpass filter is related to an external dimension of the ceramic monolithic block filter that is perpendicular to the plane wherein all the tuned resonators are located.

5. The ceramic filter of claim 1, wherein the first filter is a duplexer, comprising:

a receive filter portion and a transmit filter portion, each filter portion having a respective predetermined passband and stopband; and the lowpass filter is coupled to an antenna pad of the duplexer filter.

* * * * *